US005465643A

United States Patent [19]

Beeson

[11] Patent Number: 5,465,643

[45] Date of Patent: Nov. 14, 1995

[54] GUITAR STRING SUPPORT

[76] Inventor: David Beeson, 6 Long Ley, Church Lane, Cheddington, Nr Leighton Buzzard, Bedfordshire LU7 OSU, Great Britain

[21] Appl. No.: 351,415

[22] PCT Filed: Jun. 11, 1993

[86] PCT No.: PCT/GB93/01249

§ 371 Date: Feb. 1, 1995

§ 102(e) Date: Feb. 1, 1995

[87] PCT Pub. No.: WO93/25994

PCT Pub. Date: Dec. 23, 1993

[30] Foreign Application Priority Data

Jun. 12, 1992 [GB] United Kingdom ..... 9212545

[51] Int. Cl.[6] ..... G10D 3/00

[52] U.S. Cl. ..... 84/297 R; 84/313

[58] Field of Search ..... 84/297 R, 313

[56] References Cited

U.S. PATENT DOCUMENTS

| | | | |
|---|---|---|---|
| 4,197,779 | 4/1980 | Holman | 84/298 |
| 4,206,679 | 6/1980 | Wilson | 84/298 |
| 4,681,010 | 7/1987 | Wilkinson | 84/298 |

*Primary Examiner*—Patrick J. Stanzione

*Attorney, Agent, or Firm*—Griffin, Butler Whisenhunt & Kurtossy

[57] ABSTRACT

A guitar string support insert located between the saddle block of a guitar tremolo and each string passing over the saddle block which is held thereto by a string retaining screw operated device in order to reduce string breakage.

4 Claims, 1 Drawing Sheet

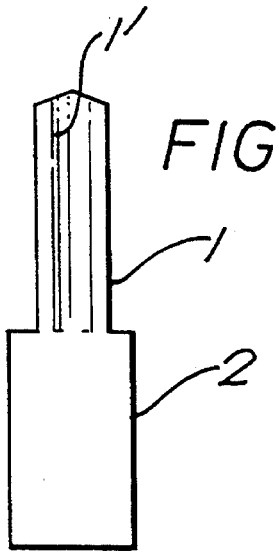
FIG. 1
FIG. 2
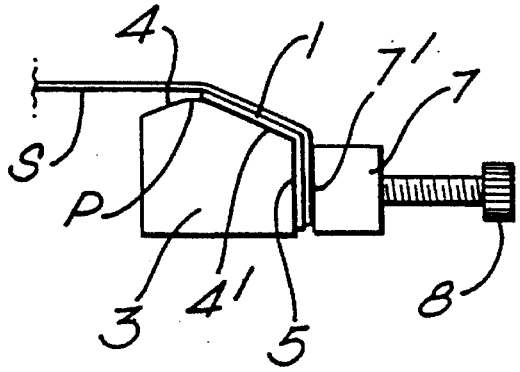
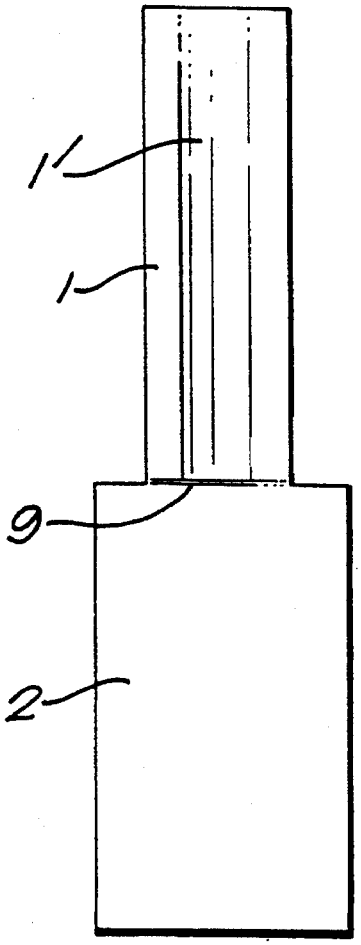
FIG. 3

GUITAR STRING SUPPORT

The present invention relates to guitars and particularly to an insert for locating between the saddle block of a guitar tremolo and each string passing over the saddle block and held thereto by a string retaining screw operated vice.

BACKGROUND OF THE INVENTION

The purpose of a tremolo device, of which there are many varieties, is to allow a guitarists to alter an existing string note by an increase or decrease of string tension. Tremolo devices typically include a saddle block and a vice grip, the guitar strings being led over the saddle block and into the vice grip which is then tightened on the saddle block to anchor the strings in position.

A recurring problem with tremolo devices of this construction is string breakage.

While it will never be possible totally to prevent guitar strings breaking for one reason or another, it is far too prevalent with tremolo devices to be acceptable although the professional guitarist tends to put up with the problem because of the advantages, in terms of the variety of sounds and effects, the tremolo device provides.

SUMMARY OF THE INVENTION

It is an object of the present invention to obviate the difficulties of the prior art and to reduce the breakage frequency of guitar strings in the area of engagement with guitar tremolo devices.

According to the invention there is provided a guitar string support insert for the string support saddle block of a guitar tremolo equipped with a saddle block and a vice grip for retaining the guitar strings to the saddle block in a string-receiving groove therein and wherein the insert is formed of a malleable metallic material softer than the metallic material, the saddle block and guitar strings and having a front section provided with an axially formed groove for lodging in the string receiving groove of the saddle block, and a rear section for insertion between the surface of the saddle block and the guitar string held in the vice grip.

Preferably the insert is made of brass.

The rear section is preferably of larger transverse width than the front section.

The junction between the front and rear sections of the insert may be provided with an indentation to enable the front and rear sections to be folded around the saddle block.

Other features and advantages of the present invention will becomes apparent from the following description of a preferred embodiment of the invention taken with reference to the accompanying drawings wherein:

BRIEF DESCRIPTION OF THE DRAWINGS

FIG. 1 is a plan view of an insert for a guitar tremolo according to one embodiment of the invention:

FIG. 2 is a cross sectional view through a guitar tremolo device showing the insert of FIG. 1 in an operative position; and FIG. 3 is a plan view of the guitar tremolo insert according to another embodiment of the invention.

DESCRIPTION OF THE PREFERRED EMBODIMENT

The guitar tremolo insert shown in FIG. 1 is made from annealed brass and has a front flat section 1 having an axial radiused string locating groove 1' and a rear flat section 2 extending from the front section 1, of wider transverse width.

Typically the thickness of the brass insert is 0.3 mm, the axial length of the front section 1 is 6.5 mm and its width 2 mm, with the axial length of the rear section 2 being 6 mm and a transverse width of 3.5 mm.

These dimensions are suitable for using the insert with a Floyd-Rose type tremolo system incorporating a saddle block 3 of the type shown in FIG. 2 having an upper surface formed of two flat surface sections 4 and 4' rising to a peak P.

A vertical flat side surface 5 of the saddle block extends to meet the flat surface section 4'.

A vice grip for retaining the guitar strings to the saddle block 3 is provided between the vertical surface 5 of the saddle block and the surface 7' of a slidable block 7 operated by a vice screw 8.

The strings of the guitar, a representative string S being shown in FIG. 2, are held in the vice grip along the tremolo, and normally extend from the grip over the surface section 4' of the saddle block 3 in a longitudinally extending radiused groove (not shown) formed therein.

As mentioned earlier in this disclosure, with this type of arrangement, breakage of guitar strings is far too prevalent since the strings and saddle block of the tremolo are both made of a hard metal such as steel causing rapid weakening of the strings at the contact area of the strings with the saddle block at the peak P during movement of the tremolo.

In addition to string breakage, consequent damage to the saddle block can occur, especially when the tremolo arm is being used. The position is not helped by the fact that the contact between the guitar strings and the saddle block over the extent of the string receiving groove therein is minimal.

As illustrated in FIG. 2 the insert of the invention is positioned between each guitar string and the saddle block 3 over the whole extent of the passage of the strings around the surface section 4' and 5 of the saddle block 3, with the rear section 2 of the insert of wider transverse with, being located in the vice grip between the surface 7' of block 7 and surface 5 of the saddle block 3, and the front section 1 lying over the surface 4' of the saddle block 3 with the radiused groove 1' received in the radiused groove in the saddle block 1.

To achieve maximum tone quality it is important that the end of the front section 1 of the insert stops at the peak P to give a sharp edged clearance between that end and the flat surface section 4 falling away from the peak P.

The malleability of the insert allows the device to be bent around the saddle block 3 as shown to configure to it, and so it may be sold in an unbent state if desired.

Since the insert is formed of softer material than both the guitar strings, being preferably brass in this embodiment, the strings form an impression in the softer material improving contact between the strings and the saddle block of the tremolo.

As the guitar strings form their impression in the softer brass material of the inserts, the latter become work hardened so that the impression does not expand into a cut.

It has been found that with the use of brass inserts according to the invention, the likelihood of guitar string breakage is reduced by up to at least ten times less than the frequency of breaking with the present arrangement.

Also since the contact between the strings and the saddle block of the tremolo is increased, improved sustained and richer tones may be produced.

In addition smoother string bending and better string grip without damaging the vice block 7 of the tremolo system is achieved.

A modified form of the invention is shown in FIG. 3. In this embodiment a slight indentation 9 is formed across the junction between the front and rear sections 1 and 2 of the insert to enable the insert to be more readily folded about this junction for shaping around the saddle block 3.

The brass insert as described may be annealed after manufacture since the end product then becomes easier to install.

What is claimed is;

1. A guitar string support insert for the string support saddle block of a guitar tremolo equipped with a saddle block and a vice grip for retaining the guitar strings to the saddle block in a string-receiving groove therein and wherein the insert is formed of a malleable metallic material softer than the metallic material of the saddle block and guitar strings and having a front section provided with an axially formed groove for lodging in the string receiving groove of the saddle block, and a rear section for insertion between the surface of the saddle block and the guitar string held in the vice grip.

2. An insert as claimed in claim 1 wherein the rear section is of larger transverse width than the front section.

3. An insert as claimed in claim 1 wherein a junction is formed between the front and rear sections of the insert, and an indentation is formed at the said junction to enable the front and rear sections to be folded around the saddle block.

4. An insert as claimed in claim 1 wherein said malleable material is brass.

* * * * *